US006751907B1

(12) United States Patent
De Gasperis

(10) Patent No.: US 6,751,907 B1
(45) Date of Patent: Jun. 22, 2004

(54) COVERED ROLLER FOR GATE SYSTEM

(75) Inventor: Joseph De Gasperis, Mississauga (CA)

(73) Assignee: Ontario, Inc., Ontario (CA)

( * ) Notice: Subject to any disclaimer, the term of this patent is extended or adjusted under 35 U.S.C. 154(b) by 0 days.

(21) Appl. No.: 10/403,613

(22) Filed: Mar. 31, 2003

(51) Int. Cl.[7] ..... E05D 15/06
(52) U.S. Cl. ..... 49/404
(58) Field of Search ..... 49/404, 425, 426, 49/427, 460; 16/86.1, 91, 95 R

(56) References Cited

U.S. PATENT DOCUMENTS

| | | | | |
|---|---|---|---|---|
| 1,394,216 | A | 10/1921 | Parker et al. | |
| 3,613,314 | A | 10/1971 | Ford | 49/425 |
| 4,628,638 | A | 12/1986 | Elko et al. | 49/426 |
| 4,723,374 | A | 2/1988 | Peterson et al. | 49/404 |
| 5,022,185 | A | 6/1991 | Oatman | 49/425 |
| 5,070,575 | A | 12/1991 | Redman et al. | 16/96 |
| 5,136,813 | A | 8/1992 | Gibbs et al. | 49/404 |
| 5,528,862 | A | 6/1996 | Streeter | 49/404 |

*Primary Examiner*—Jerry Redman
(74) *Attorney, Agent, or Firm*—Gifford, Krass, Groh, Sprinkle, Anderson & Citkowski, P.C.

(57) ABSTRACT

A gate roller apparatus for a slidable gate construction includes a shaft, a rotatable roller having a grooved periphery mounted on the shaft, and a hollow guard housing surrounding the roller, except on one side of the housing which is open. The housing has inner and outer side walls and two opposite end walls. A guard member is movably mounted on the housing adjacent at least one of the end walls and has a cavity formed in one end thereof sized to receive a portion of an elongate guiding frame of the gate. During use of the apparatus, the guiding frame moves in the grooved periphery of the roller and extends through the cavity. The guard member can be biased so as to slidingly engage an adjacent side of the guiding frame and thereby prevent inadvertent contact of fingers or clothing with the roller.

20 Claims, 3 Drawing Sheets

COVERED ROLLER FOR GATE SYSTEM

BACKGROUND OF THE INVENTION

This invention relates to gate roller apparatus and roller units for a slidable gate construction commonly used in conjunction with a fence system for industrial and farm properties.

Large, sliding gates commonly comprising a tubular frame covered with chain-link fencing are often used at a road entrance such as those found at an industrial facility or a large estate, including farm property. These large sliding gates are sometimes referred to as cantilever gates and they are mounted on rollers so that they can readily be moved horizontally to either open or close the gate without undue effort. The gate itself may consist of a long, rectangular framework constructed of tubular metal frames and to this frame work is attached a section of chain-link fencing which may correspond to that used on the fence typically located on both sides of the gate. The tubular horizontal frame members of the gate typically are mounted to ride in or on grooved rollers which are normally mounted on vertical support posts embedded in the ground adjacent the gate opening. It has been recognized that there is a potential safety hazard with cantilevered gates of this type when the rollers that support the sliding gate are exposed. When a gate has exposed rollers, it is possible for an accident to occur if a person using the gate has a finger or piece of clothing caught between one of the rollers and the adjacent horizontal frame member moving in the roller. Accordingly, efforts have been made in the past to make gate systems of this type safer, either by having the roller enclosed in some form of housing or by having the rollers move in and along an enclosed track.

U.S. Pat. No. 5,022,185 issued Jun. 11, 1991 to D. K. Oatman, describes a roller guard for a slidable fence gate having elongate, horizontal frame members of the gate supported on rollers rotatably mounted on horizontal stub shafts. The roller is surrounded by a housing, which includes opposite end walls having inverted U-shaped cavities formed in the bottom end thereof. The horizontal gate frame is able to move through these cavities while at the same time the end walls themselves provide a minimal amount of protection for fingers of a user, tending to keep the fingers away from the periphery of the roller. With this roller guard, it is still possible for there to be a significant gap between the edge of the cavity in each end wall and the horizontal frame of the gate and thus there is still a significant risk of injury with this known roller guard. Another problem with this known system is that the shaft for the roller is supported at only one end and this can create operational and maintenance difficulties for this roller unit, particularly in view of the substantial weight that can be carried by or applied to one of these covered rollers.

A more recent roller guard is that taught in U.S. Pat. No. 5,528,862 which issued Jun. 25, 1996 to Guidance Systems, Inc. This patent specification also teaches a protective roller cover for a sliding gate system, this cover having both a roller enclosure portion with an open bottom and an integral stub shaft and mounting bracket enclosure portion with an open bottom. The sub shaft and closure portion merges with the roller enclosure portion to form a unitary structure. This roller unit can be attached to an adjacent vertical post by means of two U-clamps attached to the roller unit by means of nuts. However, this known system still suffers from some of the deficiencies of the roller guard of U.S. Pat. No. 5,022,185. In particular, it is still possible for fingers to be caught in a gap between the inverted U-shaped recess formed in the end walls of the roller cover and the horizontal gate frame that extends through these recesses.

It is an object of the present invention to provide an improved gate roller apparatus that can be manufactured and sold at a reasonable cost and that provides improved protection for a user's fingers and/or clothing.

It is a further object of the present invention to provide an improved gate roller apparatus having a roller with a grooved periphery and a hollow guard housing, this housing being fitted with at least one guard member that is movably mounted adjacent at least one end wall of the housing and that helps prevent inadvertent contact of figures (or clothing) with the roller.

SUMMARY OF THE INVENTION

According to one aspect of the invention, a gate roller apparatus for a slidable gate system includes a shaft for supporting a roller, a rotatable roller having a grooved periphery mounted on the shaft, and a protective housing substantially surrounding the roller except on one side of the housing which is substantially open. The housing includes a pair of spaced, vertical side walls and at least one end wall extending between and rigidly connecting the side walls. The shaft and roller are mounted in the housing. A mounting mechanism is attachable to the housing for mounting the gate roller apparatus at a suitable fixed location for movably supporting a slidable gate of the slidable gate system. A guard member is mounted on the guard housing adjacent the at least one end wall and has one end adapted to slidingly engage an adjacent side of an elongate guiding frame of the slidable gate during use of the roller apparatus. This guard member helps to prevent a person's fingers or clothing from entering into the housing and coming into contact with the roller.

In a preferred embodiment, the housing has two of the aforementioned end walls and there is one of the guard members located at each end wall. The preferred guard member is a flat plate member having a U-shaped cavity at one end thereof.

According to another aspect of the invention, a gate roller apparatus for a slidable gate construction includes a shaft for supporting a roller, a rotatable roller having a grooved periphery mounted on the shaft, and a hollow guard housing surrounding the roller from its periphery on one side edge of the roller to a region adjacent edges of the roller on the opposite side edge of the roller. This housing has inner and outer side walls located adjacent opposite side walls of the roller, at least one end wall rigidly secured to adjacent edges of the inner and outer side walls. There is also a guard member mounted on the housing adjacent the at least one end wall and having a cavity formed in one end thereof sized and oriented to receive a portion of an elongate guiding frame of the slidable gate construction. A mounting mechanism is attachable to one side of the housing for mounting the gate roller apparatus at a suitable location for installation of the slidable gate construction. During use of the gate roller apparatus, the guiding frame is able to cooperate with the grooved periphery of the roller in order to have its longitudinal movement guided thereby. The guiding frame is able to extend through the cavity and the guard member is biased so as to slidingly engage an adjacent side of the guiding frame and thereby prevent inadvertent contact of fingers with the grooved periphery of the roller.

The preferred guard housing has two end walls, each of which is rigidly secured to the inner and outer side walls and there is one guard member movably mounted on the housing adjacent each of the two end walls.

According to a further aspect of the invention, a sliding gate system includes a horizontally extending gate having a horizontal gate support bar guided by at least one rotatable, grooved roller mounted on a shaft which in turn is supported on a vertical support post. The improvement in this gate system includes a protective housing substantially surrounding the roller, except on one side of the housing which faces the support bar. This housing includes a pair of spaced-apart vertical side walls and at least one end wall extending between and rigidly connecting the side walls. A mounting mechanism is attachable to the housing for mounting the housing and the shaft to the support post. A guard member is mounted in or on the housing adjacent the at least one end wall and has one end adapted to slidingly engage an adjacent side of the support bar during use of the gate system. The guard member helps to prevent a person's fingers or clothing from entering into the housing and coming into contact with the roller.

In a preferred embodiment, the guard member has a U-shaped cavity formed in the one end that is adapted to slidingly engage the support bar. This cavity is sized to engage a rounded top portion of the support bar in a close fitting manner.

Further features and advantages will become apparent from the following detailed description taken in conjunction with the accompanying drawings.

DETAILED DESCRIPTION OF PREFERRED EMBODIMENTS

Figure 1:
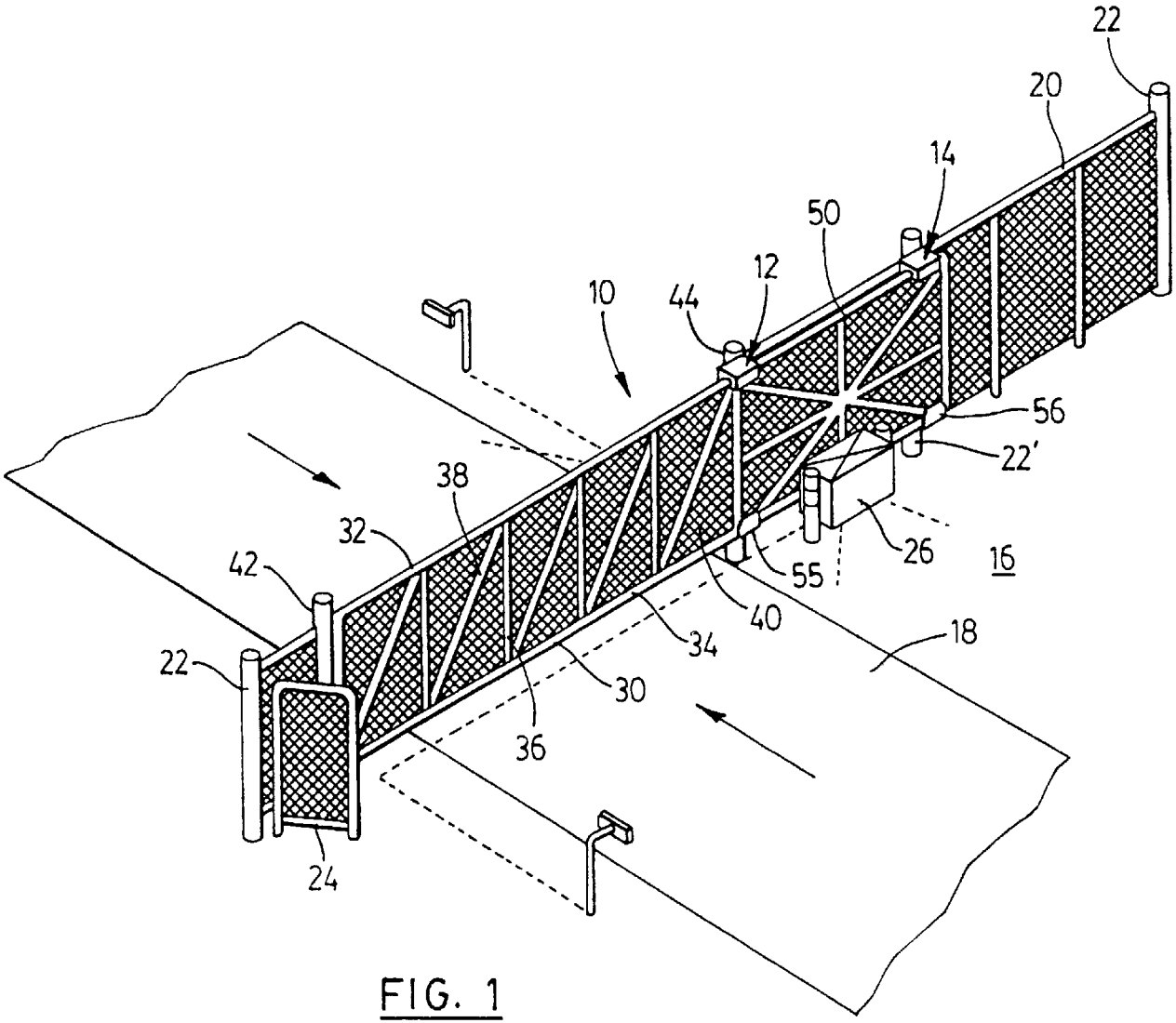
FIG. 1 is a schematic view in perspective of a sliding gate system constructed in accordance with the invention and using covered gate rollers.

FIG. 1 is a schematic illustration of a cantilever slide gate system or sliding gate system 10 that has been modified to include two of the gate roller apparatus of the invention. The two gate roller apparatus or units are used as top roller units in FIG. 1 and they are indicated at 12 and 14. It will be understood that each of the gate roller apparatus 12, 14 is constructed and mounted in the same manner and therefore only the gate roller apparatus 12 will be described in detail. It will be understood that the cantilever slide gate system 10 can be installed as the gate section of a fence that may extend around the perimeter of or along one side of an industrial or other property, a portion of which is indicated at 16. Persons and vehicles may exit or enter the property through the cantilever slide gate system 10 which extends across a roadway 18. The illustrated perimeter fence, only a small portion of which is shown, is a standard chain-link fence 20 which can include vertical support posts 22. Often there will be installed in the fence in addition to the cantilever slide gate system, a pedestrian walk gate which is illustrated at 24 which should be a predetermined distance away from the cantilever slide gate. It will be understood that the cantilever slide gate, which can be quite heavy, can be operated by means of a suitable electric motor (not shown) located in motor housing 26. It will be understood that the cantilever gate system illustrated in FIG. 1 can be of standard construction except for the covered gate roller apparatus such as the units 12 and 14. Accordingly, a detailed description of this cantilever slide gate system is deemed unnecessary herein except for the following description of the gate roller apparatus that can be used in this system either as top roller units, bottom roller units, or both.

The illustrated gate system 10 includes a horizontally extending gate 30 having elongate, horizontal gate support bars including an upper support bar or frame 32 and a lower support bar or frame 34. Both of these bars can extend the entire length of the gate and it will be understood that they are able to move horizontally with the gate by means of grooved rollers including the grooved rollers in the roller units 12 and 14. The bars or frames 32 and 34 are interconnected by rigid vertical and diagonal frame members 36 and 38. The rectangular framework formed by the bars or frames 32, 34, 36 and 38 can be covered by a strip of chain-link fencing 40. As is well known, it is common to construct the gate 30 using frame members comprising galvanized steel tubes or pipes with the frames or bars being connected to each other by means of welding. It should also be noted that the gate 30 is substantially longer than the width of the gate opening which is necessary for its support and operation. It will be understood that the gate opening extends only between the vertical fence post indicated at 42 and the fence post or gate supporting post indicated at 44. In addition to the section of the gate used to actually close the opening, there is an extra gate section 50 (also referred to as the "overhang section") which must be included in the construction of the gate to provide the necessary support when the gate is in the closed position, which is the position shown in FIG. 1. This section need contain no chain link fencing because it is not required in this extra section which overlaps with the chain link fence itself. The amount of this extra section is typically about 50% of the gate opening width.

As shown in FIG. 1, the covered roller unit 12 is mounted near the top of vertical support post 44 which is located adjacent the side of the roadway 18. Located near the bottom of the post 44 is a standard, grooved support roller, the location of which is indicated at 55. It will be understood that there is a greater need for the protective gate roller apparatus of the present invention along the top of the slidable gate than at the bottom of the slidable gate since there is a greater danger to fingers and clothing at this location. Nevertheless, if desired, a gate roller apparatus constructed in accordance with the invention can also be located at 55 and firmly attached to the post 44. It will be understood that when the gate roller apparatus of the invention is used as a bottom roller then the apparatus is turned 180 degrees from the position in which it is used as a top roller unit. In other words, when used as a bottom roller, the open side of the guard housing for the roller is positioned at the top instead of at the bottom.

Also shown in FIG. 1, the second covered roller unit 14 is located on a support post 22' which is sometimes termed the overhang post. This post 22' is positioned at a specified distance down the fence line, a distance which varies with the size of the overhang of the gate, which in turn varies with the size of the gate. With the gate in the fully closed position as shown in FIG. 1, the covered roller unit 14 is close to the end of the gate 30. The roller unit 14 is mounted near the top of the post 22' by a clamping mechanism described hereinafter. In the embodiment of FIG. 1, near the bottom of the post 22', is a standard grooved roller unit indicated at 56. Again, if desired, this standard roller unit 56 can be replaced by a covered roller unit constructed in accordance with the invention and similar to or the same as the units 12 and 14.

Figure 2:
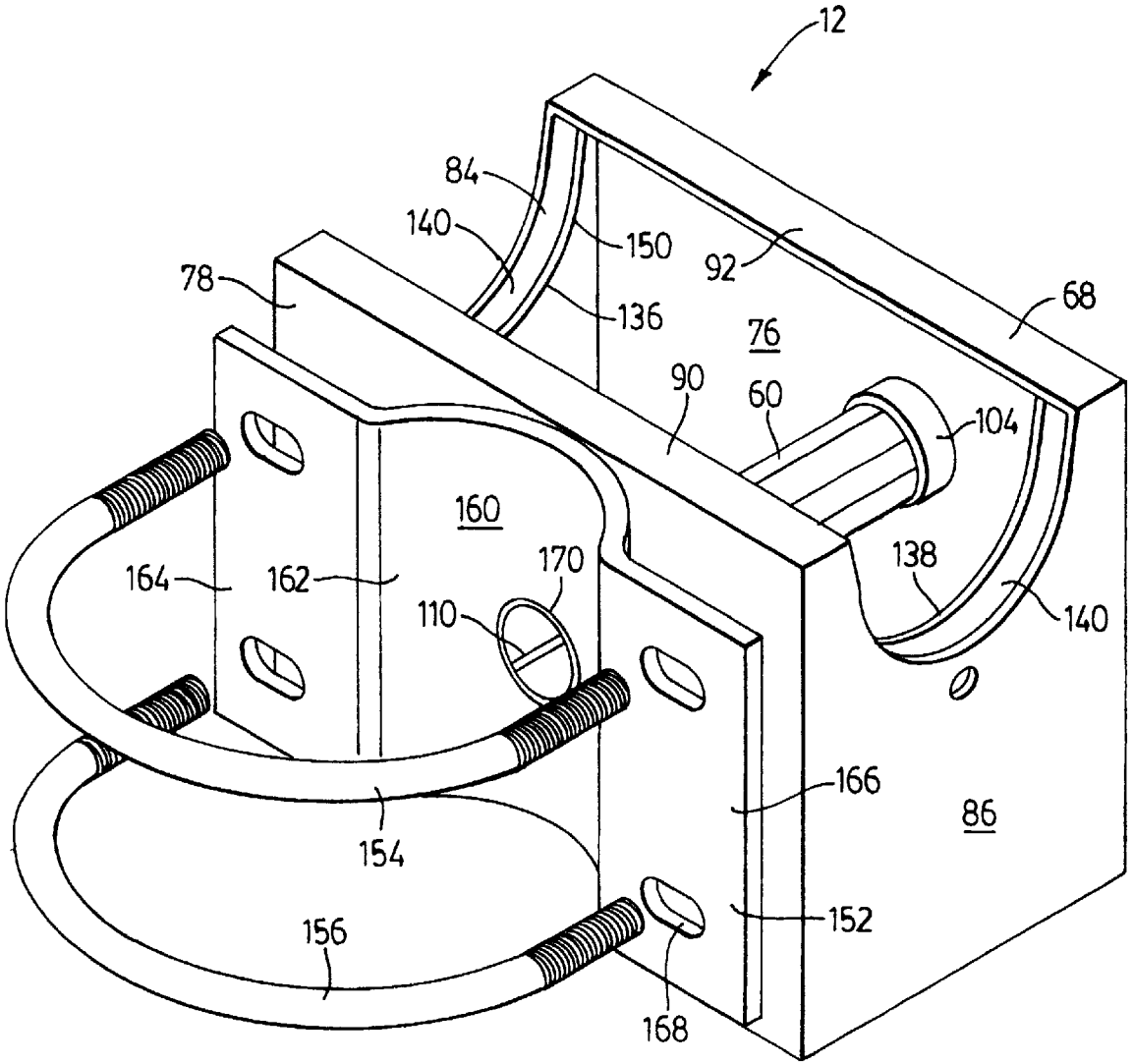
FIG. 2 is a perspective view of a preferred embodiment of gate roller housing and shaft constructed in accordance with the invention, this view omitting the roller itself but showing one end wall of the guard housing and the open side of the housing which is located at the top of the housing in this view.
Figures 3, 4:
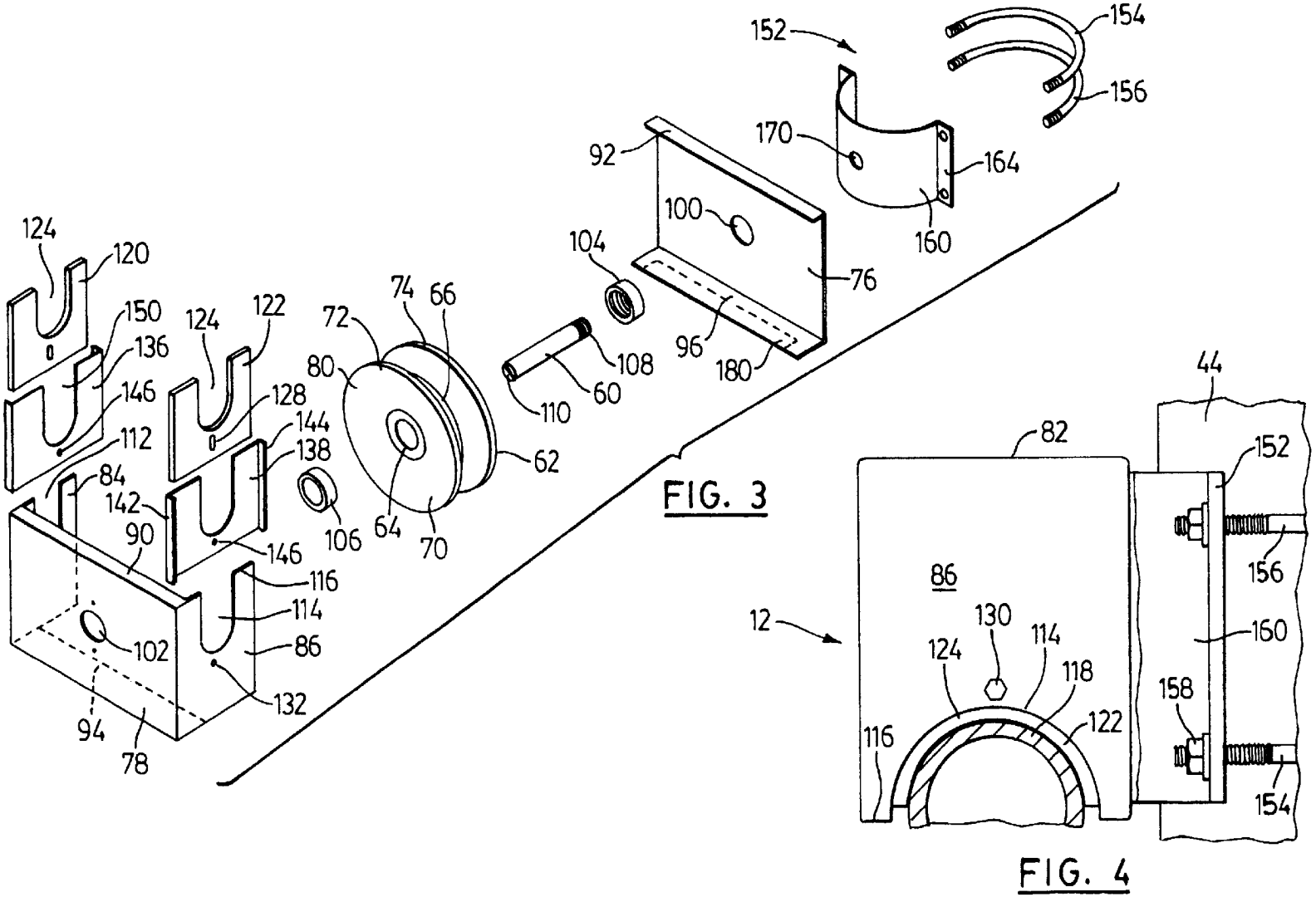
FIG. 3 is an exploded view of the gate roller housing and shaft of FIG. 2, this view showing the roller as well as the various individual components from which the housing is constructed.
FIG. 4 is an end view of the gate roller apparatus mounted as a top roller on an upper end section of a vertical support post, with only an adjacent portion of the post being shown.

Turning now to FIG. 2 which illustrates a preferred gate roller apparatus 12 constructed in accordance with the invention, it should first of all be noted that this figure illustrates the apparatus without the grooved roller for illustration purposes. The grooved roller itself which is mounted on shaft 60 can be seen in FIG. 3 and is indicated at 62. The covered roller unit 12 is shown in the inverted position in FIG. 2, that is the position that would be used if this unit is being used as a bottom roller for a sliding gate. The preferred roller is a precision machined solid ultrahigh molecular weight (UHMW) roller which is preferably fitted with prelubricated, precision sealed bearings located in central opening 64. It is also possible to use a steel roller. As these bearings are of standard, known construction, a detailed description herein is deemed unnecessary. Although the illustrated roller 62 is designed to rotate on the shaft 60, it is of course possible to fixedly attach the roller on the shaft and then mount the shaft 60 so that it freely rotates. In the latter case, sealed bearings can be used to mount the ends of the shaft. It will also be seen that the roller has a grooved periphery at 66 and it will be understood that this periphery is sized in its transverse cross-section to closely match the cross-section of the gate bar or frame which moves along the roller. The gate roller apparatus 12 also has a hollow guard housing 68 which surrounds the roller from its periphery on one side edge 70 of the roller to a region adjacent edges 72 and 74 on the opposite side edge of the roller. The guard housing has an inner side wall 76 and an outer side wall 78, these side walls being located adjacent opposite side walls of the roller when the roller is installed in the housing. One of these roller side walls can be seen at 80 in FIG. 3. The housing also has a top wall 82 which preferably completely seals the top of the housing (see FIG. 4) and two end walls 84 and 86. These end walls are rigidly secured to adjacent edges of the inner and outer side walls and to adjacent edges of the top. Although it is possible to construct the guard housing with only one end wall, it is preferable for safety and strength reasons to have two end walls 84 and 86 as this increases the strength and rigidity of the housing and increases the safety aspect of the housing by closing the housing at both ends. The housing has one side (which in FIG. 2 is the top side) which is substantially open. If desired, this side can be partially closed by edge flanges 90 and 92 which can be integrally formed with the side walls of the housing. Also, as shown in FIG. 3, the closed horizontal side, which is side 82 in FIG. 4, can be formed by two half side sections, 94, 96, which can be integrally formed with the side walls as well. When these two half side sections are welded together along their long free edges, they form a completely closed top (in the case of the FIG. 4 version) or bottom (in the position of FIG. 2). For purposes of mounting and locating the shaft 60, the two side walls 76, 78 are respectively formed with central holes 100 and 102. Welded to the inside of the side wall 76 and aligned with the hole 100 is an internally threaded support sleeve 104. Welded to the inside of the side wall 78 is a non-threaded support sleeve 106. The shaft 60 is formed with a threaded end at 108 and this end can be threaded into the sleeve 104 by means of a screwdriver using transverse slot 110 formed in one end of the shaft. It will thus be understood that the shaft and roller can be installed in the housing by first placing the grooved roller in the housing so that its central hole is aligned with the holes in the sleeves 104 and 106. The shaft 60 is then inserted through the hole 102, through the sleeve 106, through the roller and then threaded into the sleeve 104. In this way, the roller is securely held in the required position and can be easily removed later, if required. Furthermore, it will be seen that the shaft 60 is fully supported at both ends thereof and this provides further strength for the preferred roller unit of this invention.

Preferably, each of the end walls 84, 86 has a U-shaped recess 112, 114 formed in one end thereof, this end 116 being adjacent the one side of the housing which is substantially open. As illustrated in FIG. 4, each recess 114, 116 is dimensioned to receive an adjacent portion 118 of the guiding frame of the gate during use of the roller apparatus. As illustrated in FIG. 4, the recess receives approximately one half of the cross-sectional area of the guiding frame. It will be understood that when the gate roller apparatus 12 is being used as an upper or top roller (as shown in FIGS. 1 and 4), the recess 112, 114 is located in the lower end of the end wall and is adapted to receive an upper portion of the guiding frame. Alternatively, if the gate roller apparatus is being used as a bottom roller unit, then the recess 114, 116 is located at the upper end of the end wall and it is arranged to receive the lower portion of the horizontal, lower guiding frame of the gate.

The illustrated and preferred gate roller apparatus is fitted with two guard members 120 and 122 which are mounted in the guard housing adjacent a respective one of the two end walls 84, 86. Each guard member has a cavity 124 which is preferably U-shaped as shown since generally speaking the guiding frame of the gate that extends through the cavity has a circular exterior cross-section. However, it is possible that the cavity 124 can have a different shape, particularly if the cross-section of the guiding frame is not round but is rectangular or square, for example. The cavity 124 is sized and oriented to receive a portion of an elongate guiding frame of the slidable gate construction as illustrated in FIG. 4. In the preferred embodiment illustrated in FIG. 4, the cavity 124 is sized to snugly receive at least the upper half of the cross-section of the horizontal guiding frame 118. The guiding frame 118 is able to extend through each of the cavities 124 and each guard member 120, 122 is adapted to slidably engage an adjacent side of the guiding frame and thereby prevent inadvertent contact of fingers with the grooved periphery of the roller 62.

The preferred form of guard member is a flat plate member that is made of a suitable rigid plastics material. The plastics material should be sufficiently strong to withstand sliding engagement with the guiding frame for an extensive period of time and it should generate little frictional force between the wall of its cavity and the adjacent metal guiding frame during the sliding movement. A suitable plastics material for this purpose is ultrahigh molecular weight (UHMW) plastic, a known form of low friction, durable plastic. The preferred U-shaped cavity 124 has its open side located adjacent the open side of the guard housing. Although the illustrated guard members are mounted against the inner surface of their respective adjacent end wall, it will be readily apparent to those skilled in the art that it is also possible to mount each guard member against the outer surface of the end wall, if desired, particularly if it is not necessary for the gate roller apparatus to withstand severe weather conditions such as freezing rain, snow and ice.

Also, preferably, the guard member is formed with a small, bolt receiving slot 128. A suitable, short hex bolt 130 (visible in FIG. 4) can extend through a hole 132 formed in the adjacent end wall of the housing and through the slot 128. It will be understood that this bolt acts to hold the guard member in the required position for engagement with the side of the horizontal guiding frame of the gate while at the same time allowing some degree of vertical movement of the guard member. A threaded nut can be secured to the end of the bolt to hold it in place. The provision of this bolt attachment is primarily to ensure that the guard member remains in place in the housing while being shipped and during the installation process.

Another preferred feature of the gate roller apparatus is the provision of two internal support walls 136 and 138, each of which is located adjacent a respective one of the end walls 84, 86 but is spaced therefrom so as to form a guard member slot 140 which can be seen clearly in FIG. 2. Each of these support walls, 136, 138, extends parallel to the adjacent end wall and provides support for a respective one of the guard members 120, 122, which is held in the slot. Each of these internal support walls can be constructed in the same manner and therefore only the support wall 138 is described further herein. The support wall 138 can be formed from a single sheet metal plate which can be galvanized plate, if desired. This plate member is formed with vertical edge flanges 142, 144. These edge flanges can be used to attach the support wall to the inside of the housing and also act as spacers to correctly position the internal support wall with respect to the end wall and allow sufficient space between the internal support wall and the end wall. Each support wall is also provided with a bolt hole 146 to receive a threaded end of the aforementioned bolt 130. Thus, the nut that holds the bolt 130 is tightened against the surface of the support wall opposite the guard member. Of course, each of the support walls 136, 138 is also formed with its own U-shaped recess 150 which can have a size similar to or the same as the U-shaped recess in the adjacent end wall.

The preferred gate rolling apparatus is also equipped with a mounting mechanism indicated generally at 152 which is attached to or attachable to one side of the guard housing for mounting the gate roller apparatus at a suitable location for installation of the slidable gate construction. In the illustrated preferred embodiment, this mounting mechanism is a metal clamping device that includes two threaded U-clamps 154, 156 and threaded fasteners, for example, nuts 158 for securing the U-clamps in place. The preferred clamping device also includes a bent clamping plate 160 that can be welded on one side to the inner side wall of the guard housing. The plate 160 has a smoothly curved central section 162 and two flat wing sections 164, 166. Elongate holes 168 for receiving the threaded ends of the U-clamps are formed in the wing sections. As illustrated, there are two of the holes 168 in each wing section and these holes are located near the top and bottom of the wing section. There is also a central, circular hole 170 formed in the curved central section 162, this hole sized to permit insertion of the roller shaft 60 into the housing. It will be appreciated that the clamping plate 160 is placed against the side of the supporting vertical post, for example, the post 44, a portion of which can be seen in FIG. 4. Once this is done and the gate roller apparatus has been properly positioned, the two U-clamps 154, 156 can then be placed around the post and attached to the clamping plate 160 by means of washers and the bolts 158. It will be appreciated that this construction provides a very firm connection between the roller housing and the adjacent supporting post. It will be understood that the clamping devices can be provided in various sizes to fit various standard post sizes ranging from 3 inch posts to posts having a diameter 6⅝ths inches or more.

It should be appreciated that there are some differences in the construction of and operation of the gate roller apparatus of the invention depending on whether or not it is being used as a top roller for a cantilever gate or a bottom roller. If the gate roller apparatus is being used as a top roller assembly, then it is constructed in the manner described above and, in particular, the top wall of the housing will be completely closed to protect the roller and its shaft and the inside of the housing from the weather and the elements. In this situation, the two guard members are biased against the top of the horizontal guiding frame of the gate by means of gravitational force. This is advantageous because it permits the guard member to ride smoothly and allows for some distortion in the horizontal guiding frame that is in engagement with the guard member. The biasing force also helps to ensure that the guard member always rests against the top surface of the guiding frame, thereby avoiding any gap that may otherwise exist between the guiding frame and the end wall of the housing. Thus, the guard members effectively prevent inadvertent contact of fingers and/or clothing with the grooved periphery of the roller.

On the other hand, when the gate roller apparatus of this invention is being used for a bottom roller, in the preferred embodiment, the bottom of the guard housing has a reasonably large opening formed therein so that debris, snow, etc., can readily fall out of the housing and will not interfere with the operation of the roller. The provision of this possible opening is indicated firstly by the dashed line at the bottom of the inner side wall 76 as shown in FIG. 3. This dashed line outlines a rectangular section 180 that would be cut out in the construction of the bottom roller unit. A similar cutout would be removed from the half side section 94 that forms the other half of this wall of the housing.

Furthermore, with respect to the bottom roller unit, it will be appreciated that the plastic guard members are not biased by gravity into engagement with the horizontal guiding frame of the gate. The length of each guard member is adjusted or set prior to installation so that it will slidingly or closely engage the adjacent side of the slidable guiding frame. A very close fit or engagement between the guard member and the horizontal, lower guiding frame is generally not as important as is the case with the top roller units where generally there is a greater danger of fingers and/or clothing coming into contact with the roller. If a biasing mechanism for a bottom roller unit is desired, this could be done by means of a suitable spring arranged in the slot between the guard member and the bottom of the housing.

It should be understood that although the preferred embodiment of the gate roller apparatus of this invention has a guard member located at each end of the housing, it is possible to construct a gate roller apparatus which has only a guard member at one end of the housing, for example, that end where there is a greater danger of fingers or clothing being caught between the roller and the frame of the gate. In addition, it is also possible to construct the guard housing with an end wall at only one end of the housing, provided the housing otherwise has the necessary structural rigidity and strength. For example, a housing with an end wall at only one end might be used at some locations where the opposite end of the housing is closed or protected by other means, for example, by an adjacent wall or a guard plate mounted on an adjacent support structure.

The preferred material for the roller housing is steel plate which can be painted to prevent corrosion.

A further advantage of the covered gate roller apparatus of the invention, particularly when it is used as an upper roller unit, is that the roller is substantially covered and thus the roller is protected from snow and ice. This in turn can extend the useful working life of the covered gate roller. Also, with the preferred shaft mounting as illustrated and described above, the shaft can readily be removed if it becomes necessary to remove the roller from the housing and, for example, replace a bearing.

It will be readily apparent to those skilled in the construction of gates and, in particular, cantilever gates, that various modifications and changes can be made to the described gate roller apparatus without departing from the spirit and scope of this invention. Accordingly, all such modifications and changes as fall within the scope of the appended claims are intended to be included in this invention.

What is claimed is:

1. A gate roller apparatus for a slidable gate construction comprising:

a shaft for supporting a roller;

a rotatable roller having a grooved periphery mounted on said shaft;

a hollow guard housing surrounding said roller from its periphery on one side edge of the roller to a region adjacent edges of said roller on the opposite side edge of the roller, said guard housing having inner and outer side walls located adjacent opposite side walls of said roller and at least one end wall rigidly secured to adjacent edges of said inner and outer side walls;

a guard member mounted on said guard housing adjacent said at least one end wall and having a cavity formed in one end thereof sized and oriented to receive a portion of an elongate guiding frame of said slidable gate construction; and a mounting mechanism attached to one side of said guard housing for mounting said gate roller apparatus at a suitable location for installation of the slidable gate construction;

wherein during use of said gate roller apparatus, said guiding frame is able to co-operate with said grooved periphery of said roller in order to have its longitudinal movement guided thereby, said guide frame is able to extend through said cavity, and said guard member is adapted to slidingly engage an adjacent side of said guiding frame and thereby prevent inadvertent contact of fingers with said grooved periphery of said roller.

2. A gate roller apparatus according to claim 1 wherein said guard housing has two of said at least one end walls, both of said end walls are rigidly secured to said inner and outer side walls, and there is one of said guard member mounted on said guard housing adjacent each of the two end walls.

3. A gate roller apparatus according to claim 1 wherein said guard member is a flat plate member and is movably mounted adjacent an inner surface of said at least one end wall.

4. A gate roller apparatus according to claim 1 wherein said guard member is made of a rigid plastics material and said cavity is U-shaped with the open side of the cavity located adjacent an open side of said guard housing.

5. A gate roller apparatus according to claim 4 wherein said mounting mechanism is a metal clamping device that includes two threaded U-clamps and threaded fasteners for securing the U-clamps in place.

6. A gate roller apparatus according to claim 2 wherein each guard member is a flat, plastic plate member which is movably mounted adjacent an inner surface of the adjacent end wall of the guard housing and is biased by gravity to engage said adjacent side of the guiding frame during use of the apparatus as a top gate roller.

7. A gate roller apparatus according to claim 2 wherein said guard housing includes two internal support walls each of which is located adjacent a respective one of said end walls but is spaced therefrom so as to form a guard member slot, each support wall extending parallel to the adjacent end wall and providing support for a respective one of the guard members which is held in the guard member slot.

8. A gate roller apparatus for a slidable gate system comprising:

a shaft for supporting a roller;

a rotatable roller having a grooved periphery mounted on said shaft;

a protective housing substantially surrounding said roller except on one side of the housing which side is substantially open, said housing including a pair of spaced vertical side walls and at least one end wall extending between and rigidly connecting said side walls, said shaft and roller being mounted in said housing;

a mounting mechanism attachable to said housing for mounting said gate roller apparatus at a suitable fixed location for movably supporting a slidable gate of the slidable gate system; and a guard member mounted on said housing adjacent said at least one end wall and having one end adapted to slidingly engage an adjacent side of an elongate guiding frame of said slidable gate during use of said roller apparatus, whereby said guard member helps to prevent a person's fingers or clothing from entering into said housing and coming into contact with said roller.

9. A gate roller apparatus according to claim 8 wherein said housing has two of said at least one end wall and there is one of said guard member located at each end wall.

10. A gate roller apparatus according to claim 9 wherein each guard member is a flat plate member having a U-shaped cavity at one end thereof, said cavity being open towards said one side of the housing which is substantially open and said cavity being dimensioned to receive in a close fitting manner an adjacent portion of said guiding frame during use of said roller apparatus.

11. A gate roller apparatus according to claim 10 wherein each end wall has a U-shaped recess formed in one end thereof, said one end being adjacent said one side of the housing which is substantially open, and wherein each recess is dimensioned to receive an adjacent portion of said guiding frame during use of said roller apparatus.

12. A gate roller apparatus according to claim 10 wherein each guard member is made of a wear-resistant, rigid plastics material and, when said roller apparatus is installed to support a top horizontal guiding frame of said slidable gate, each guard member is movable and is biased to slidingly engage an adjacent side portion of said guiding frame.

13. A gate roller apparatus according to claim 9 wherein, when said roller apparatus is installed as a top roller for said slidable gate, each guard member is movable and is biased by gravitational force into engagement with said adjacent side portion.

14. A gate roller apparatus according to claim 9 wherein said housing includes two internal support walls each of which is fixedly mounted adjacent a respective one of the end walls but is spaced therefrom to form a guard member receiving slot, each of said support walls extending vertically and parallel to the adjacent end wall and providing support for a respective one of the guard members which is movable in the receiving slot.

15. In a sliding gate system which includes a horizontally extending gate having a horizontal gate support bar guided by at least one rotatable, grooved roller mounted on a shaft which is supported by a vertical support post, the improvement comprising:

a protective housing substantially surrounding said roller except on one side of the housing which faces said support bar, said housing including a pair of spaced-apart vertical side walls and at least one end wall extending between and rigidly connecting said side walls;

a mounting mechanism attachable to said housing for mounting the housing and said shaft to said support post;

a guard member mounted in or on said housing adjacent said at least one end wall and having one end adapted to closely engage an adjacent side of the support bar during use of the gate system, whereby said guard member helps to prevent a person's fingers or clothing from entering into said housing and coming into contact with said roller.

16. A sliding gate system according to claim 15 wherein said guard member is movably mounted and is a planar member made of rigid plastics material and a U-shaped cavity is formed in said one end of said guard member and sized to engage a rounded top portion of said support bar in a close fitting manner.

17. A sliding gate system according to claim 16 wherein said shaft is supported at opposite ends thereof by said pair of side walls of said housing and said mounting mechanism is a clamping device connected to said housing, said clamping device including two U-clamps and threaded fasteners for securing said U-clamps to said support post.

18. A sliding gate system according to claim 16 wherein said gate support bar is an upper gate support bar extending along a top of said gate, said protective housing has a closed top side, a substantially open bottom side, and two of said at least one end wall, and there are two of said guard member with each movably mounted adjacent a respective one of the end walls.

19. A sliding gate system according to claim 18 wherein each end wall of the housing has a U-shaped recess formed in a bottom end thereof and each recess is dimensioned to receive an adjacent portion of said gate support bar.

20. A sliding gate system according to claim 16 wherein said housing includes two of said at least one end wall, there are two of said planar guard member with each mounted adjacent an inner surface of a respective one of the end walls, said housing has two internal support walls each of which is fixedly mounted adjacent one of the end walls but is spaced therefrom to form a guard member holding slot, and each of said support walls provides support for a respective one of the guard members which is vertically movable in its holding slot.

* * * * *

UNITED STATES PATENT AND TRADEMARK OFFICE

CERTIFICATE OF CORRECTION

PATENT NO. : 6,751,907 B1
DATED : June 22, 2004
INVENTOR(S) : Joseph De Gasperis It is certified that error appears in the above-identified patent and that said Letters Patent is hereby corrected as shown below:

Title page,
Item [56], References Cited, U.S. PATENT DOCUMENTS, replace "3,613,314 10/1971 Ford" with -- 3,613,314 10/1969 Ford --.

Signed and Sealed this

Third Day of May, 2005

JON W. DUDAS
*Director of the United States Patent and Trademark Office*